US012194333B2

(12) United States Patent
Crandall

(10) Patent No.: US 12,194,333 B2
(45) Date of Patent: Jan. 14, 2025

(54) FREE MOTION SWING ARM

(71) Applicant: Shaun Crandall, Las Cruces, NM (US)

(72) Inventor: Shaun Crandall, Las Cruces, NM (US)

( * ) Notice: Subject to any disclaimer, the term of this patent is extended or adjusted under 35 U.S.C. 154(b) by 0 days.

(21) Appl. No.: 18/758,653

(22) Filed: Jun. 28, 2024

(65) Prior Publication Data

US 2024/0350859 A1 Oct. 24, 2024

Related U.S. Application Data

(63) Continuation of application No. 18/299,845, filed on Apr. 13, 2023.

(51) Int. Cl.

| | |
|---|---|
| ***A63B 21/08*** | (2006.01) |
| ***A63B 21/00*** | (2006.01) |
| ***A63B 21/06*** | (2006.01) |
| ***A63B 21/072*** | (2006.01) |
| ***A63B 21/078*** | (2006.01) |

(52) U.S. Cl.

CPC ..... *A63B 21/0615* (2013.01); *A63B 21/0724* (2013.01); *A63B 21/078* (2013.01); *A63B 21/08* (2013.01); *A63B 21/4035* (2015.10); *A63B 21/4049* (2015.10)

(58) Field of Classification Search

CPC ..... A63B 21/4035; A63B 21/4049; A63B 21/0615; A63B 21/0616; A63B 21/0617

See application file for complete search history.

(56) References Cited

U.S. PATENT DOCUMENTS

| | | | | |
|---|---|---|---|---|
| 7,918,771 | B2 * | 4/2011 | Rogers | A63B 21/4035 482/100 |
| D898,137 | S * | 10/2020 | Carmichael | D21/686 |
| 11,517,785 | B1 * | 12/2022 | Nolan | A63B 17/04 |
| 11,896,867 | B1 * | 2/2024 | Nolan | A63B 21/4027 |
| 12,005,289 | B1 * | 6/2024 | Johnson | A63B 21/4035 |
| 2007/0155595 | A1 * | 7/2007 | Rogers | A63B 21/08 482/97 |
| 2019/0269963 | A1 * | 9/2019 | Steenekamp | A63B 23/1254 |
| 2022/0323815 | A1 * | 10/2022 | Simental | A63B 21/0557 |

OTHER PUBLICATIONS

Griffin Adjustable Lever Arms, Feb. 10, 2022, https://griffin.fitness/rack-attachments/griffin-adjustable-lever-arms/ (Year: 2022).*

Major Fitness Lever Arms, 2024, https://www.major-lutie.com/products/lever-arm (Year: 2024).*

* cited by examiner

*Primary Examiner* — Joshua T Kennedy

(74) *Attorney, Agent, or Firm* — Dunlap Bennett & Ludwig, PLLC

(57) ABSTRACT

A free-motion swing arm includes a rack mount; a swivel joint; a hollow tubular arm; and a U bracket with a handle and a weight bearing post extending from opposite surfaces. The rack mount has a handle and mounts on an exercise rack. The swivel joint includes a bearing and a mounting plate, mounts on the rack mount, and rotates about a vertical axis. The arm is mounted to the mounting plate, rotates about a horizontal axis, and is reversibly lockable in multiple positions. The U bracket is mounted to the arm. The swing arm allows movement 180 degrees on both a vertical axis and horizontal axis and in between at the same time for free movement.

12 Claims, 3 Drawing Sheets

FREE MOTION SWING ARM

BACKGROUND OF THE INVENTION

The present invention relates to power rack attachments and, more particularly, to a free motion swing arm.

Currently available power rack attachments such as jammer arms only move in a vertical axis, up and down, for example. They don't allow for horizontal movement or a free movement of the arms in any direction the user needs.

As can be seen, there is a need for a power rack attachment that enables the user to move more freely.

SUMMARY OF THE INVENTION

In one aspect of the present invention, a free-motion swing arm mountable on an exercise rack comprises a rack mount with a first handle on a first surface; a swivel joint rotatable about a vertical axis mounted on a second surface of the rack mount, the swivel joint comprising a bearing and a mounting plate coupled to the bearing; a hollow tubular arm hingedly mounted to the mounting plate and rotatable about a horizontal axis; and a U bracket mounted to the hollow tubular arm, having a second handle extending from a first surface of the U bracket and a weight bearing post extending from a second surface of the U bracket. The hollow tubular arm is reversibly lockable in a plurality of positions.

With a free motion articulating arm and housing, the swing arm/jammer arms allow movement 180 degrees on both a vertical axis and horizontal axis and any combination therebetween at the same time for free movement.

These and other features, aspects and advantages of the present invention will become better understood with reference to the following drawings, description, and claims.

DETAILED DESCRIPTION OF THE INVENTION

Figure 1:
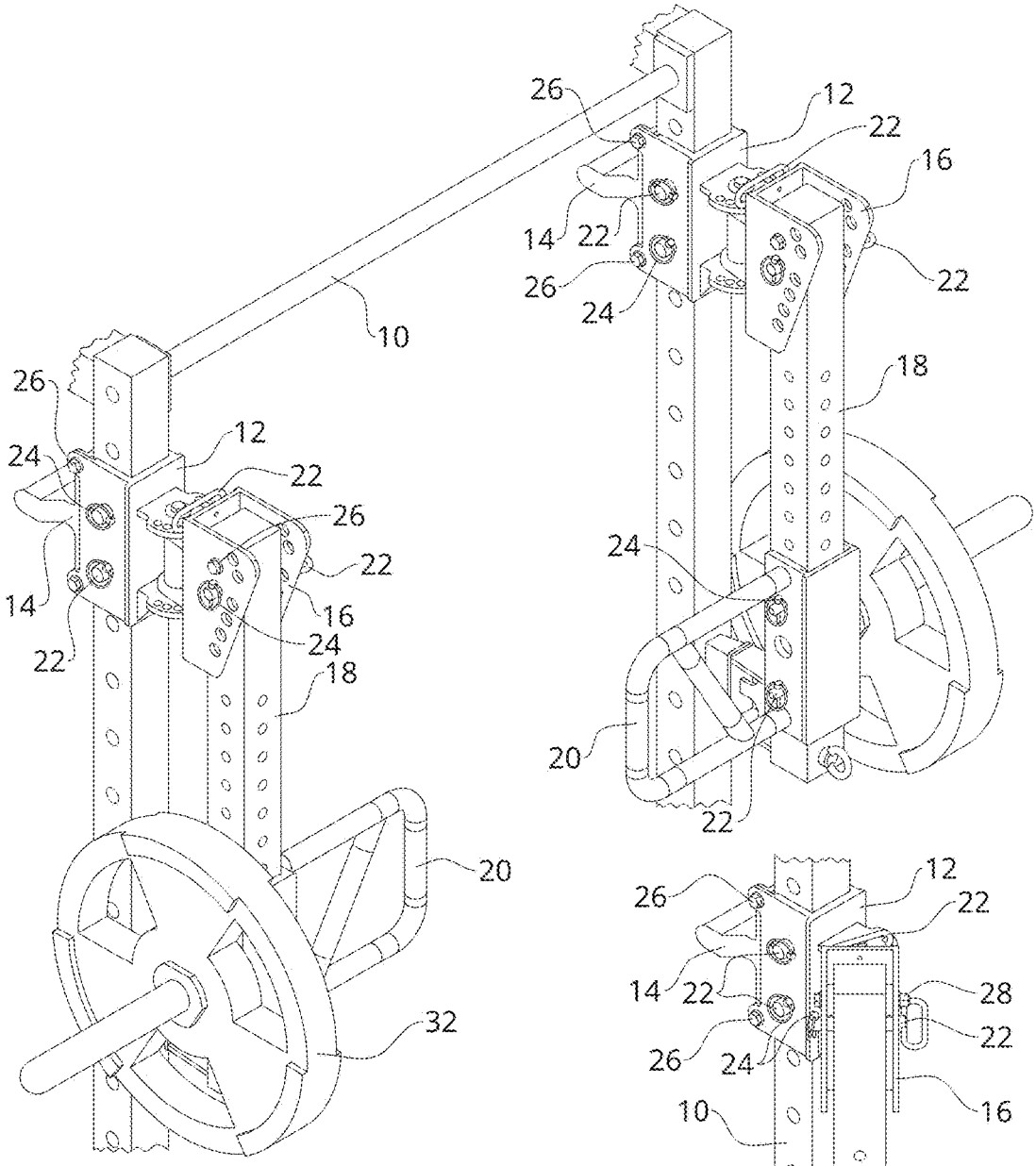
FIG. 1 is a perspective view of a free motion swing arm according to an embodiment of the present invention, shown in the environment of a power rack.
Figure 2:
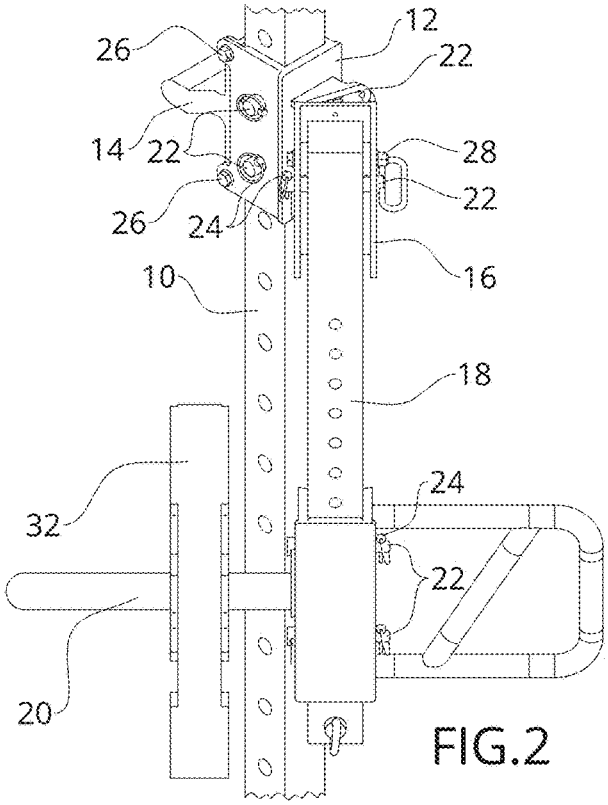
FIG. 2 is a perspective view thereof, in a pivoted position.
Figure 3:
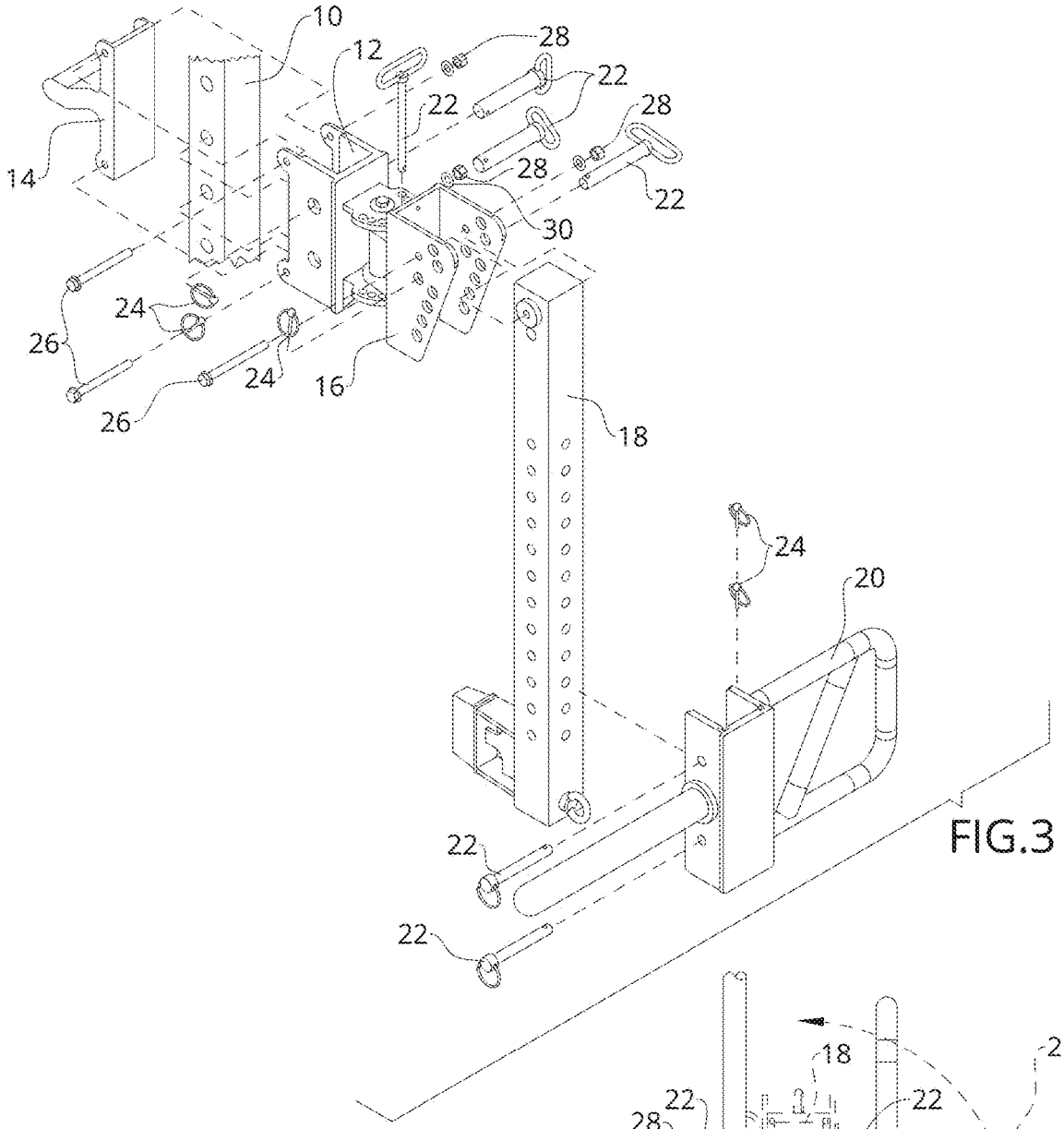
FIG. 3 is an exploded view thereof.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a swing arm or jammer arm that allows for free movement both 180° around a horizontal axis and 180° around a vertical axis.

The inventive free motion swing arm comprises a swivel joint that enables 180° movement of the arms in both a horizontal and a vertical plane of motion. The swivel joint enables free full 360-degree motion in unison. It can be locked at multiple angles as well.

The free motion swing arm may be mounted to an exercise rack; for example, it may be mounted to an upright and/or a crossmember thereof.

It slides up and down the uprights or back and forth on a crossmember.

The swivel joint comprises steel plates with holes operative to accommodate pins. This allows the arm to be locked in place at various angles and arm heights for user safety. The number of holes is not particularly limited.

In some embodiments, the holes may include enlarged holes in various locking positions to accommodate a thicker pin.

The swivel joint comprises a vertical bearing between the arm and a clamp that fastens the swing arm to the upright of a power rack, between two steel plates with holes.

In some embodiments, the bearing size may be increased in size to improve weight capacity.

In some embodiments, the swivel joint may be moved closer to the power rack to alleviate torque on the bearing.

A handle and loadable weight sleeve is adjustably mounted on the arm with pins, e.g., two pins. The sleeve may be, for example, a 2-inch Olympic sized sleeve. Weight plates may be added to the sleeve and secured with barbell collars.

The swing arm has three primary adjustments. The handle and sleeve may be adjusted up and down the arm based on what exercise the user is performing. The ending or bottom height of the arm's vertical movement may be adjusted at the end of the arm closest to the swivel joint. A single pin can be secured in multiple positions, e.g., 4. This is most beneficial for pressing movements where the user does not have the range of motion to drop the arm below the level of their body. The final adjustment may be done on the swivel joint itself. A single pin may be used to select a start and ending horizontal angle of the arm. The arm can also be left without a pin in the swivel joint to allow for full 180-degree horizontal motion.

Referring to FIGS. 1 through 6, FIGS. 1-3 illustrate an apparatus according to an embodiment of the present invention, mounted to an exercise frame 10 with a clamp 12, adjustable with a handle 14 coupled thereto with washers 30 (see FIG. 3), nuts 28, and bolts 26, and fastened with locking pins 22 retained by retaining pins 24, and bolts 26. A locking pivot 16 comprises a metal plate having a substantially truncated wedge shape and a bearing coupled to the clamp 12 with locking pins 22 pivots around a vertical axis. The truncated wedge-shaped metal plate accommodates an arm 18 which rotates around a horizontal axis, fastened with bolts 26, nuts 28 (see FIG. 2), and washers 30 (see FIG. 3) and releasably lockable in a variety of positions with locking pins 22 retained by retaining pins 24 that pass through the truncated wedge-shaped plate and the arm 18. A combined handle and weight holder 20 mounted to the arm 18 is secured in a selected position with locking pins 22 retained by retaining pins 24 and fastened with bolts 26, nuts 28, and washers 30. At an end opposite the pivot 16, the arm 18 has a stop element to prevent movement past the lower vertical position. The handle portion is substantially U-shaped with a crossbar. Weights 32 are removably fastened to the weight holder 20.

Figure 4:
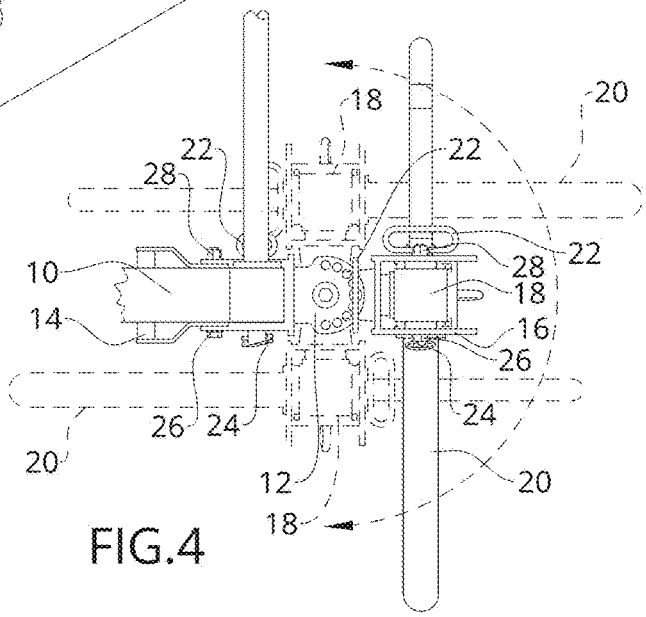
FIG. 4 is a top plan view thereof, illustrating motion around a first axis.

As shown in FIG. 4, the locking pivot 16 rotates around a vertical axis, along a horizontal plane, at the clamp 12 and may be fixed in position with locking pins 22.

Figure 5:
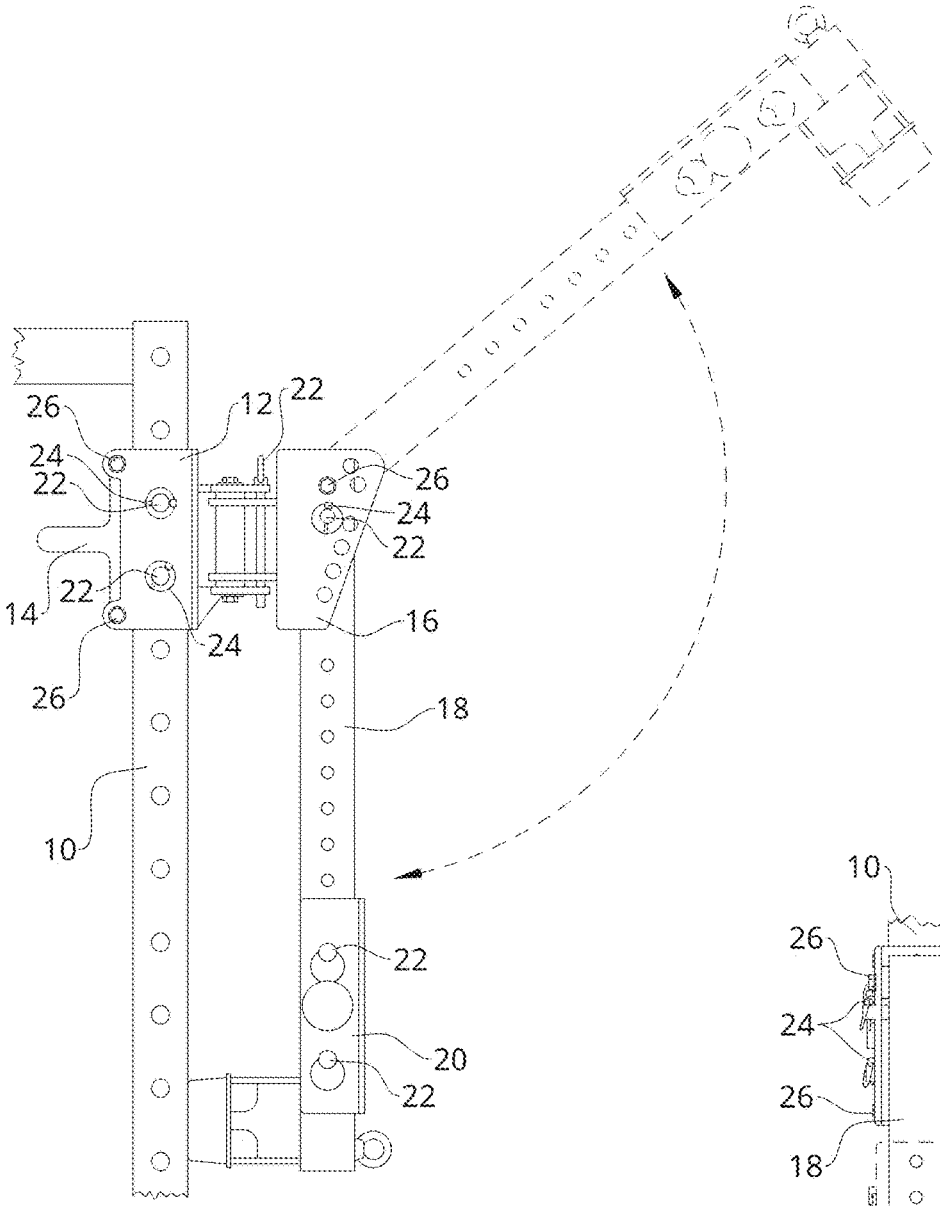
FIG. 5 is a front elevation view thereof, illustrating motion around a second axis.

FIG. 5 show vertical movement of the arm 18 about a horizontal axis. The arm 18 may be fixed in position with locking pins 22 coupled with retaining pins 24.

Figure 6:
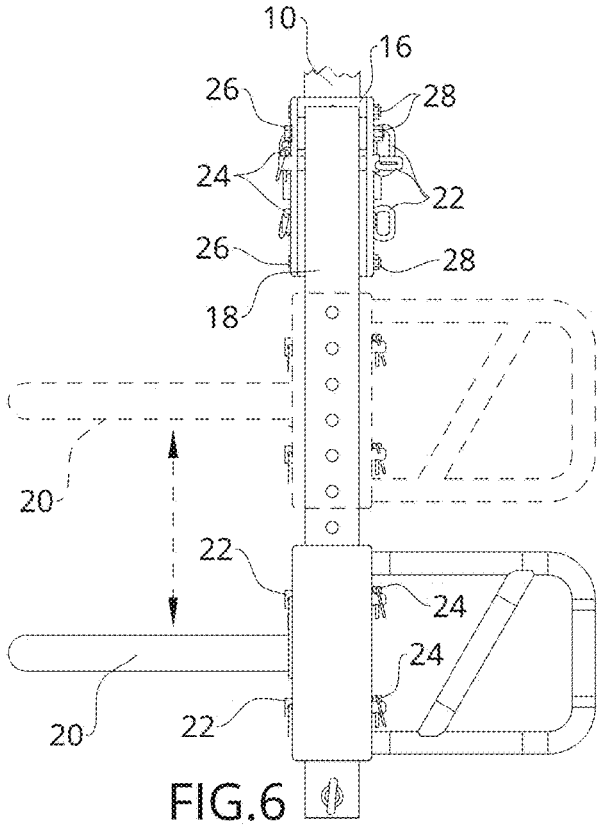
FIG. 6 is a side elevation view thereof, illustrating vertical adjustment of the apparatus.

FIG. 6 illustrates adjustability of the apparatus, such that the weight holder 20 may be moved to a selected position on the arm 18 and fastened in place with locking pins 22 coupled with retaining pins 24.

It should be understood, of course, that the foregoing relates to exemplary embodiments of the invention and that modifications may be made without departing from the spirit and scope of the invention as set forth in the following claims.

What is claimed is:

1. A free-motion swing arm mountable on an exercise rack, comprising:

a clamp mountable on the exercise rack, the clamp having a front, a back wall, and two side walls, a first handle and clamp apertures on the side walls, through which one or more locking pins extend and are configured to secure the clamp to an exercise rack frame;

a first joint assembly coupled to extending from the front of the clamp, a second joint assembly coupled to the first joint assembly, wherein the first joint assembly allows the second joint assembly to be rotatable about a first axis, and the first joint assembly comprises one or more metal plates with a plurality of holes that allow the second joint assembly to be lockable in a first position relative to the first axis;

an arm coupled to the second joint assembly, wherein the second joint assembly allows the arm to be rotatable about a second axis orthogonal to the first axis, and the second joint assembly comprises one or more metal plates with a plurality of holes that allow the arm to be lockable in a second position relative to the second axis; and a bracket coupled to the arm, the bracket having a second handle extending from a first surface of the bracket and a weight bearing post extending from a second surface of the bracket;

whereby, the clamp, first joint assembly, second joint assembly, arm and bracket are configure to be slidably movable along an exercise rack frame when one or more locking pins are not engaged by insertion through clamp side wall apertures, but stay locked in place when one or more locking pins are so engaged.

2. The free-motion swing arm of claim 1, wherein the arm is a hollow tubular arm.

3. The free-motion swing arm of claim 1, wherein the holes in the metal plates of the first and second joint assemblies are configured to accommodate locking pins.

4. The free-motion swing arm of claim 1, wherein the first axis is vertical.

5. The free-motion swing arm of claim 1, wherein the second axis is horizontal.

6. The free-motion swing arm of claim 1, wherein the first joint assembly allows the second joint assembly to be rotatable by 180 degrees about the first axis.

7. The free-motion swing arm of claim 1, wherein the second joint assembly allows the arm to be rotatable by 180 degrees about the second axis.

8. The free-motion swing arm of claim 1, wherein the first joint assembly allows the second joint assembly to be rotatable by 180 degrees about the first axis and the second joint assembly allows the arm to be rotatable by 180 degrees about the second axis.

9. The free-motion swing arm of claim 1, wherein the second handle is substantially U-shaped and has a crossbar.

10. The free-motion swing arm of claim 1, wherein the bracket is a U bracket.

11. The free-motion swing arm of claim 1, wherein the one or more metal plates of the second joint assembly comprises a truncated wedge shape with a plurality of holes on said shape that allow the arm to be lockable in a second position relative to the second axis.

12. The free-motion swing arm of claim 1, wherein the plurality of holes in the one or more metal plates of the first joint assembly are evenly spaced in a half ring.

* * * * *